US010282996B1

(12) United States Patent
Buchbut et al.

(10) Patent No.: US 10,282,996 B1
(45) Date of Patent: May 7, 2019

(54) COLLISION PREVENTION BASED ON CONNECTED DEVICES

(71) Applicant: GM Global Technology Operations LLC, Detroit, MI (US)

(72) Inventors: Yohay Buchbut, Pardes-Hanna (IL); Eilon Riess, Zikron-Yaakov (IL); Tal Philosof, Givatayim (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/910,082

(22) Filed: Mar. 2, 2018

(51) Int. Cl.
*G08G 1/16* (2006.01)
*G08G 1/0967* (2006.01)

(52) U.S. Cl.
CPC ..... *G08G 1/166* (2013.01); *G08G 1/0967* (2013.01)

(58) Field of Classification Search
CPC ..... G08G 1/00; G08G 1/005; G08G 1/08; G08G 1/017; G08G 1/0967; G08G 1/0969; G08G 1/16; G08G 1/166
USPC ..... 340/539.1, 539.11, 539.13, 573.1, 573.3, 340/903; 455/456, 456.1
See application file for complete search history.

(56) References Cited

U.S. PATENT DOCUMENTS

| | | | | |
|---|---|---|---|---|
| 7,084,757 | B2 * | 8/2006 | Terui | G08G 1/0104 340/436 |
| 9,421,909 | B2 * | 8/2016 | Strickland | B60Q 9/008 |
| 2005/0073438 | A1 * | 4/2005 | Rodgers | G08G 1/161 340/944 |
| 2013/0141576 | A1 * | 6/2013 | Lord | G08G 1/04 348/148 |
| 2018/0075747 | A1 * | 3/2018 | Pahwa | B60W 40/09 |
| 2018/0114435 | A1 * | 4/2018 | Singh | G08G 1/005 |
| 2018/0122240 | A1 * | 5/2018 | Shirosaki | H04W 4/023 |

* cited by examiner

*Primary Examiner* — Hung T Nguyen
(74) *Attorney, Agent, or Firm* — Cantor Colburn LLP

(57) ABSTRACT

A method of performing collision prevention and a system to perform collision prevention involve a communication interface to receive information from connected devices of individuals. The system also includes a processor to obtain the information from the connected devices, estimate a potential for an upcoming collision, and issue an alert based on the potential for the upcoming collision to one or more of the connected devices.

18 Claims, 3 Drawing Sheets

COLLISION PREVENTION BASED ON CONNECTED DEVICES

The subject disclosure relates to collision prevention based on connected devices.

Connected devices are increasingly used by the general public. Exemplary connected devices include cellular devices (e.g., smart phones, wearable devices) that use cellular networks to send and receive information or use cellular networks indirectly via Bluetooth or Wi-Fi, for example. Many drivers of vehicles (e.g., automobile, truck, construction equipment) carry cellular devices as they are driving. Other road users (e.g., pedestrians, bikers) may also have cellular devices. Cellular devices facilitate information gathering and analysis in addition to communication. For example, drivers may receive traffic information or directions while driving using cellular devices. Drivers may also report accidents or hazardous situations using cellular devices or cellular-based telematics systems. While reporting a situation or a collision (e.g., via an application running on a cellular device) after it has occurred is helpful, anticipating a potential collision and communicating information to try to prevent it would be even more helpful. Accordingly, it is desirable to provide collision prevention based on connected devices.

SUMMARY

In one exemplary embodiment, a collision prevention system includes a communication interface to receive information from connected devices of individuals. The system also includes a processor to obtain the information from the connected devices, estimate a potential for an upcoming collision, and issue an alert based on the potential for the upcoming collision to one or more of the connected devices.

In addition to one or more of the features described herein, the communication interface is further configured to receive other information from other sources additional to the connected devices of the individuals.

In addition to one or more of the features described herein, the other information includes weather information.

In addition to one or more of the features described herein, the other information includes infrastructure information indicating traffic light information.

In addition to one or more of the features described herein, the other information includes road condition information.

In addition to one or more of the features described herein, the communication interface receives the information only from the connected devices of the individuals that are road users, and the information indicates whether each of the road users is a pedestrian, biker, or driver of a vehicle.

In addition to one or more of the features described herein, the communication interface receives the information indicating a classification of the vehicle based on the road user being the driver of the vehicle.

In addition to one or more of the features described herein, the communication interface receives location, speed, and heading from each of the connected devices.

In addition to one or more of the features described herein, the processor develops a digital map from the information.

In addition to one or more of the features described herein, the processor estimates the potential for the upcoming collision based on the digital map and issue the alert to one or more connected devices corresponding with the potential collision.

In another exemplary embodiment, a method of performing collision prevention includes receiving, at a central controller, information from connected devices of individuals. The method also includes estimating, at the central controller, a potential for an upcoming collision based on the information, and issuing an alert based on the potential for the upcoming collision.

In addition to one or more of the features described herein, the method also includes receiving, at the central controller, other information from other sources additional to the connected devices of the individuals.

In addition to one or more of the features described herein, the receiving the other information includes receiving weather information.

In addition to one or more of the features described herein, the receiving the other information includes receiving infrastructure information indicating traffic light information.

In addition to one or more of the features described herein, the receiving the other information includes receiving road condition information.

In addition to one or more of the features described herein, the receiving the information includes receiving the information only from the connected devices of the individuals that are road users, and the information indicating whether each of the road users is a pedestrian, biker, or driver of a vehicle.

In addition to one or more of the features described herein, the receiving the information includes receiving the information indicating a classification of the vehicle based on the road user being the driver of the vehicle.

In addition to one or more of the features described herein, the receiving the information includes receiving the information indicating location, speed, and heading from each of the connected devices.

In addition to one or more of the features described herein, the method also includes developing a digital map from the information.

In addition to one or more of the features described herein, the estimating the potential for the upcoming collision is based on the digital map and issuing the alert is to one or more connected devices corresponding with the potential collision.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
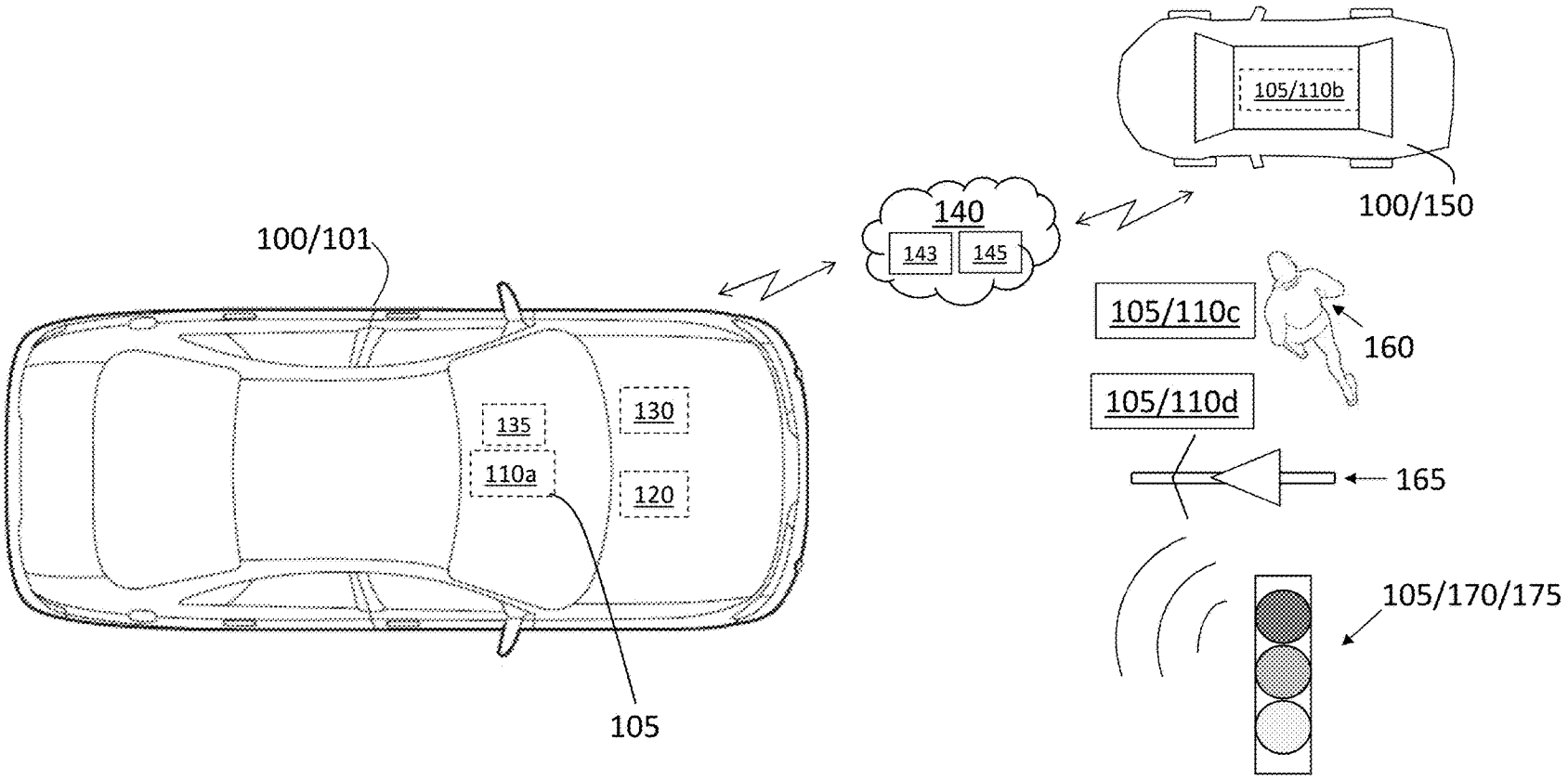
FIG. 1 depicts an exemplary scenario illustrating collision avoidance based on connected devices.

The following description is merely exemplary in nature and is not intended to limit the present disclosure, its application or uses. It should be understood that throughout the drawings, corresponding reference numerals indicate like or corresponding parts and features.

As previously noted, connected devices (e.g., smart phones, telematics systems) may be used to report a collision after it has occurred. While this communication may aid in rescue and traffic control efforts, for example, communication that facilitates collision avoidance is desirable. Embodiments of the systems and methods detailed herein relate to collision avoidance based on connected devices. The exemplary connected devices discussed for explanatory purposes are cellular devices. However, devices that are connected via Wi-Fi or other communication networks are within the scope of the contemplated embodiments.

Specifically, according to one or more embodiments, information is gathered from cellular devices carried by various road users (e.g., vehicle drivers, pedestrians, bikers). The cellular devices may determine, based on location and other factors, when the carrier of the cellular device is a road user. As such, information provided by the cellular devices may be limited to cellular devices of road users. The cellular devices may include sensors that obtain information such as location, speed, heading, acceleration, deceleration, and height above ground.

The information gathering and processing is discussed with reference to a cloud-based server, referred to as a central controller, for explanatory purposes. However, any processing system, or set of processing systems, that obtain the information may perform the processes described herein. The central controller may obtain additional information from other sources such as weather information or information about infrastructure such as traffic lights and road signs. This information may be provided directly or by a central command office, for example. The central controller processes all the information obtained from the various cellular devices and other sources to identify a potential collision event and generate corresponding alerts to try to avert the incident.

In accordance with an exemplary embodiment, FIG. 1 depicts an exemplary scenario illustrating collision avoidance based on connected devices 105. The exemplary vehicle 100 is an automobile 101. The connected devices 105 are connected via a cellular network in the exemplary embodiment. A cellular device 110*a* (generally referred to as 110) is a connected device 105 shown in the vehicle 100. In addition to the cellular device 110*a*, the exemplary vehicle 100 includes sensors 120 (e.g., radar, lidar, camera) and a controller 130 that may control vehicle systems (e.g., autonomous driving or braking, adaptive cruise control) or be coupled to vehicle systems. The exemplary controller 130 and vehicle systems may facilitate augmented or autonomous vehicle operation according to one or more embodiments. The vehicle 100 shown in FIG. 1 also includes an infotainment system 135 that facilitates displays to the driver of the vehicle 100. The controller 130 may issue alerts and information to the driver via the infotainment system 135 and may alternately or additionally issue alerts via visual (e.g., flashing lights) or audio devices or via vibration of the driver seat, for example.

The cellular device 110*a* and controller 130 may both communicate with a central controller 140 (e.g., a cloud server as shown in FIG. 1). FIG. 1 shows another vehicle 100, which may be an emergency vehicle 150 (e.g., police or fire vehicle), for example, a pedestrian 160, and a bicycle 165. Each of these is associated with a connected device 105, cellular devices 110*b*, 110*c*, 110*d*, respectively, that may also communicate with the central controller 140. A traffic light 175 is shown and represents connected infrastructure 170, which is another type of connected device 105. Information about the connected infrastructure 170 may be provided directly (i.e., via transmission capability of the infrastructure 170) or through a different server (e.g., traffic control central server) to the central controller 140. The information from the traffic light 175 may include the status and timing of the lights (e.g., currently illuminated light is green and will transition to yellow in 5 seconds). Other connected infrastructure 170 may transmit information to indicate the presence of a sharp curve within a particular distance or a hazardous weather condition (e.g., ice on the road, flooding), for example. In alternate or additional embodiments, the connected infrastructure 170 may be temporary. For example, a police officer may set up connected infrastructure 170 with the ability to communicate with the central controller 140 at an accident site to indicate lane narrowing due to a previous accident.

As previously noted, each cellular device 110 may include sensors such as a global positioning system (GPS) 210 (FIG. 2), which obtains location information and may be associated with a mapping application, and inertial sensors (e.g., accelerometer 220 (FIG. 2), gyroscope 230). The cellular device 110 provides information to the central controller 140 such as location, speed, heading, acceleration, deceleration, and height above ground, which may indicate that the location is on a bridge or overpass, for example. Each of the cellular devices 110 may transmit information to the central controller 140 in a filtered or processed manner based on processing by a controller 240 (FIG. 2) of the cellular device 110.

Filtering refers to the cellular device 110 transmitting information to the central controller 140 only when the person carrying the cellular device 110 is determined to be a road user. Thus, a given cellular device 110 may monitor location and movement to determine if the person carrying the cellular device 110 is a road user or not. For example, if the person carrying the cellular device 110 is located at a sidewalk café, the location may imply that the person is a road user but the lack of movement over a specified period of time would indicate that the person is not a road user and, as a result, the cellular device 110 may not transmit information to the central controller 140.

Processing refers to the cellular device 110 classifying the information based on analyzing the data collected by the sensors and providing processed information to the central controller 140. For example, the cellular device 110*a* may use information from the sensors to classify the weight and class of the automobile 101 as a passenger car, heavy truck, or the like. The cellular device 110*c* may classify the person carrying the cellular device 110*c* as a pedestrian 160 based on the location (e.g., on the sidewalk) and speed, for example. This classification information may be provided to the central controller 140 along with other information such as location, speed, and the like. According to additional or alternate embodiments, processing of cellular data may be done by another processor (e.g., cloud-based processor) that does the classifying, for example.

The central controller 140 uses information obtained from the cellular devices 110 and information from the other sources such as connected infrastructure 170 to determine if there is a potential for collision, as further detailed. The central controller 140 includes a communication interface 143 to exchange messages (e.g., obtain information, issue alerts) with connected devices 105 such as the cellular devices 110. The central controller 140 also includes processing circuitry 145. The processing circuitry 145, as well as the controller 130 and controller 240 may include an application specific integrated circuit (ASIC), an electronic circuit, a processor (shared, dedicated, or group) and memory that executes one or more software or firmware programs, a combinational logic circuit, and/or other suitable components that provide the described functionality.

The central controller 140 develops a digital map based on the information transmitted to it by connected devices 105. For example, based on information from connected infrastructure 170 and cellular devices 110, the central controller 140 may develop a digital map 200 like the one shown in FIG. 2 and indicates the location and heading of each road user. The information may indicate or be used to determine the type of each road user (e.g., driver of a vehicle 100, pedestrian 160, cyclist of a bicycle 165). The class of each vehicle 100 may also be indicated or determined from the information.

Figure 2:
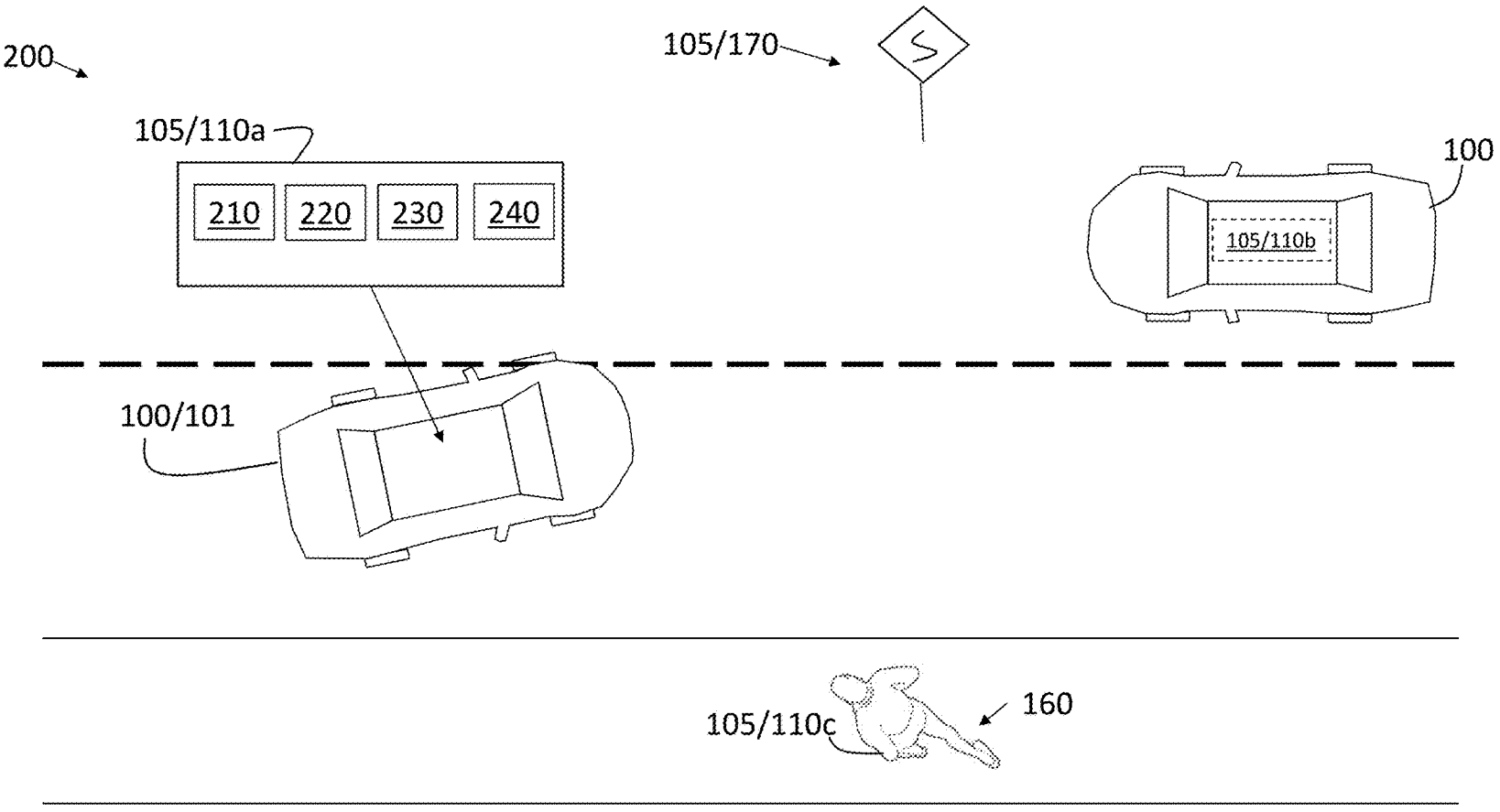
FIG. 2 shows an exemplary digital map developed by the central controller to perform collision prevention based on connected devices according to one or more embodiments.

FIG. 2 shows an exemplary digital map 200 developed by the central controller 140 to perform collision prevention based on connected devices 105 according to one or more embodiments. The roadway and sidewalk may be represented based on information from the GPS 210 of one or more cellular devices 110 and mapping information available to the central controller 140. Other sensors 120 may be used to determine a precise location of the vehicle 100, as well. An automobile 101 is shown with a cellular device 110*a*. FIG. 2 indicates sensors in the cellular device 110*a* as including the GPS 210, accelerometer 220, and gyroscope 230. The cellular device 110*a* also includes a controller 240 that may perform the filtering and processing discussed above. These exemplary sensors are not an exhaustive listing of the sensors that may be included in the cellular device 110*a*. A pedestrian 160 with a wearable cellular device 110*c* is shown on the sidewalk. Connected infrastructure 170 in the form of a road sign is also shown. This sign may indicate an upcoming sharp curve, for example. Another vehicle 100 is shown in FIG. 2 in an adjacent lane and travelling in the opposite direction as the automobile 101. Cellular device 110*b* is shown in the other vehicle 100.

As the digital map 200 of FIG. 2 indicates, the automobile 101 has a heading that may result in a collision with the other vehicle 100. Based on this digital map 200, the central controller 140 may issue warnings to both cellular device 110*a* and cellular device 110*b*. The wearable cellular device 110*c* would not be issued a warning according to the scenario shown in FIG. 2. The warning received by the cellular devices 110*a*, 110*b* may be communicated to the controllers 130 of the automobile 101 and the other vehicle 100, respectively. As a result, driver alerts may be provided on the infotainment systems 135 of the automobile 101 and the other vehicle 100, for example.

As another example, even if the heading of the automobile 101 were not problematic, the speed of the other vehicle 100 may be determined to be too high for the approaching sharp curve indicated by the connected infrastructure 170. In this case, a warning may be issued only to the other vehicle 100. For example, the driver may be issued an alert on the infotainment system 135 of the other vehicle 100 indicating that speed should be reduced due to an approaching sharp curve.

Figure 3:
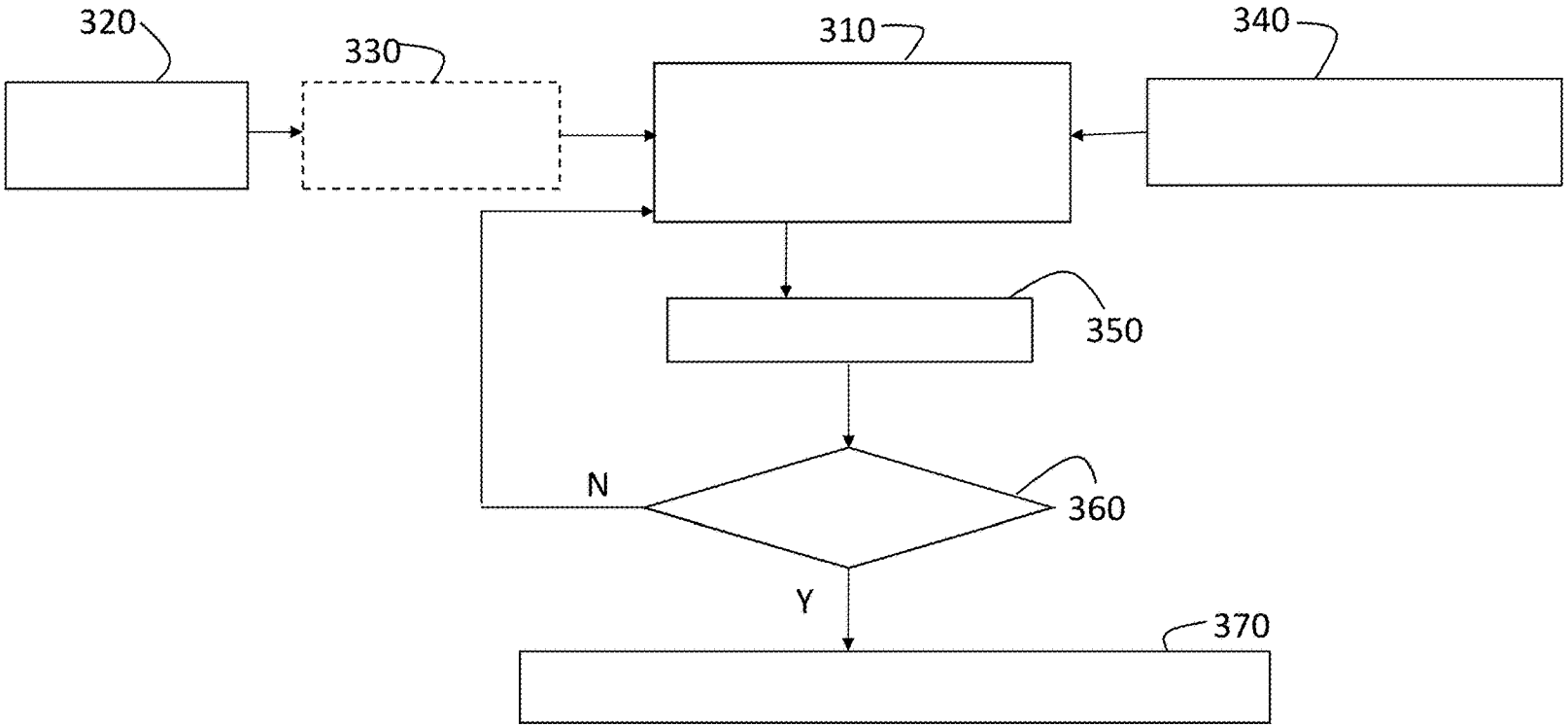
FIG. 3 is a process flow of a method of performing collision prevention based on connected devices according to one or more embodiments.

FIG. 3 is a process flow of a method of performing collision prevention based on connected devices 105 such as cellular devices 110 and connected infrastructure 170, according to one or more embodiments. At block 310, the processes include receiving information from connected devices 105 at the central controller 140. This information may come from several sources and types of sources. At block 320, cellular devices 110 may obtain sensor information using the sensors discussed previously. These sensors may indicate location, speed, heading, and the like. At block 330, the controller 240 of each cellular device 110 may be used to filter or process the information. The filtering may result in only cellular devices 110 that are associated with road users transmitting to the central controller 140. The processing may result in information about the type of road user (e.g., driver of a vehicle 100 and classification of the vehicle 100, pedestrian 160) being transmitted to the central controller 140. At block 340, transmitting from connected infrastructure 170 facilitates the central controller 140 obtaining information about road and weather conditions, for example.

Developing a digital map 200, at block 350, includes the central controller 140 using the information received from the various connected devices 105, at block 310. At block 360, a check is done by the central controller 140 of whether a collision is possible based on the digital map 200. If it is, transmitting a warning to affected connected devices 105, at block 370, refers to the central controller 140 issuing a warning only to those connected devices 105 that may be affected by the potential collision. If the check, at block 360, determines that a collision is not possible according to the digital map 200, then the process of receiving information resumes, at block 310.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A collision prevention system, comprising:

a plurality of connected devices, each of the plurality of connected devices being configured to determine, by using a location and a movement of the connected device, whether the connected device is a road user connected device that is used on a roadway or in motion on a sidewalk;

a communication interface configured to receive information from only the road user connected devices among the plurality of connected devices; and a processor configured to obtain the information from only the road user connected devices, estimate a potential for an upcoming collision, and issue an alert based on the potential for the upcoming collision to one or more of the road user connected devices.

2. The system according to claim 1, wherein the communication interface is further configured to receive other information from other sources additional to the road user connected devices of the individuals.

3. The system according to claim 2, wherein the other information includes weather information.

4. The system according to claim 2, wherein the other information includes infrastructure information indicating traffic light information.

5. The system according to claim 2, wherein the other information includes road condition information.

6. The system according to claim 1, wherein the communication interface is configured to receive the information indicating a classification of the vehicle based on the road user being the driver of the vehicle.

7. The system according to claim 1, wherein the communication interface is configured to receive location, speed, and heading from each of the road user connected devices.

8. The system according to claim 1, wherein the processor is further configured to develop a digital map from the information.

9. The system according to claim 8, wherein the processor is further configured to estimate the potential for the upcoming collision based on the digital map and issue the alert to one or more road user connected devices corresponding with the potential collision.

10. A method of performing collision prevention, the method comprising:

for each of a plurality of connected devices, determining, using a location and a movement of the connected device, whether the connected device is a road user connected device that is used on a roadway or in motion on a sidewalk;

receiving, at a central controller, information from only the road user connected devices among the plurality of connected devices; and estimating, at the central controller, a potential for an upcoming collision based on the information; and issuing an alert, from the central controller, based on the potential for the upcoming collision.

11. The method according to claim 10, further comprising receiving, at the central controller, other information from other sources additional to the road user connected devices of the individuals.

12. The method according to claim 11, wherein the receiving the other information includes receiving weather information.

13. The method according to claim 11, wherein the receiving the other information includes receiving infrastructure information indicating traffic light information.

14. The method according to claim 11, wherein the receiving the other information includes receiving road condition information.

15. The method according to claim 10, wherein the receiving the information includes receiving the information indicating a classification of the vehicle based on the road user being the driver of the vehicle.

16. The method according to claim 10, wherein the receiving the information includes receiving the information indicating location, speed, and heading from each of the road user connected devices.

17. The method according to claim 10, further comprising developing a digital map from the information.

18. The method according to claim 17, wherein the estimating the potential for the upcoming collision is based on the digital map and issuing the alert is to one or more road user connected devices corresponding with the potential collision.

* * * * *